US009987510B2

(12) United States Patent
Beagen et al.

(10) Patent No.: US 9,987,510 B2
(45) Date of Patent: Jun. 5, 2018

(54) FIRE PROTECTION SPRINKLER TRIGGER ASSEMBLY

(71) Applicant: TYCO FIRE PRODUCTS LP, Lansdale, PA (US)

(72) Inventors: Joseph W. Beagen, West Warwick, RI (US); Jose L. Almeida, Warwick, RI (US); Kenneth W. Rogers, Horsham, PA (US)

(73) Assignee: Tyco Fire Products LP, Lansdale, PA (US)

( * ) Notice: Subject to any disclaimer, the term of this patent is extended or adjusted under 35 U.S.C. 154(b) by 0 days. days.

(21) Appl. No.: 14/775,673

(22) PCT Filed: Mar. 12, 2014

(86) PCT No.: PCT/US2014/025052
§ 371 (c)(1),
(2) Date: Sep. 12, 2015

(87) PCT Pub. No.: WO2014/159766
PCT Pub. Date: Oct. 2, 2014

(65) Prior Publication Data

US 2016/0023030 A1 Jan. 28, 2016

Related U.S. Application Data

(60) Provisional application No. 61/782,401, filed on Mar. 14, 2013.

(51) Int. Cl.

| | |
|---|---|
| ***A62C 37/12*** | (2006.01) |
| ***B05B 12/12*** | (2006.01) |
| *A62C 37/09* | (2006.01) |

(52) U.S. Cl.
CPC ..... *A62C 37/12* (2013.01); *B05B 12/12* (2013.01); *A62C 37/09* (2013.01)

(58) Field of Classification Search
CPC ..... A62C 37/12; A62C 37/09; B05B 12/12
(Continued)

(56) References Cited

U.S. PATENT DOCUMENTS

| | | | | |
|---|---|---|---|---|
| 2,591,872 A | | 4/1952 | Rider | |
| 3,195,647 A | * | 7/1965 | Campbell | A62C 37/09 137/72 |

(Continued)

OTHER PUBLICATIONS

International Search Report and Written Opinion for International Application PCT/US2014/025052, Applicant Tyco Fire Products LP, dated Oct. 2, 2014, 11 pages.

(Continued)

*Primary Examiner* — Jason Boeckmann
(74) *Attorney, Agent, or Firm* — Perkins Coie LLP

(57) ABSTRACT

A sprinkler assembly including a sprinkler frame having a proximal portion, a distal portion and an internal surface defining an internal fluid passageway having an inlet and an outlet extending axially to define a central sprinkler axis of the frame. The distal portion includes a plurality of surfaces to define a pair of chambers disposed about the passageway. The sprinkler assembly includes a seal assembly and a lever assembly having a first configuration to support the seal assembly and a second configuration to release the seal assembly. The lever assembly includes a pair of lever members in which each has lever member h a first end. In the first configuration, the first end forms a frictional engagement within a chamber to support the seal assembly in an unactuated state of the sprinkler frame.

15 Claims, 3 Drawing Sheets

(58) Field of Classification Search
USPC ..... 169/37, 90, 40
See application file for complete search history.

(56) References Cited

U.S. PATENT DOCUMENTS

| | | | | |
|---|---|---|---|---|
| 4,596,289 | A | 6/1986 | Johnson | |
| 4,976,320 | A | 12/1990 | Polan | |
| 5,664,630 | A | 9/1997 | Meyer et al. | |
| 6,152,236 | A * | 11/2000 | Retzloff ..... | A62C 37/14 169/19 |
| 6,367,559 | B1 | 4/2002 | Winebrenner | |
| 2010/0263883 | A1 | 10/2010 | Abels et al. | |

OTHER PUBLICATIONS

Tyco Fire & Building Products, BlazeMaster® CPVC Fire Sprinkler Data Sheet TFP1915, Jun. 2008, 2 pages.
Jan. 4, 2016 IFW of U.S. Appl. No. 61/782,401, filed Mar. 14, 2013.

* cited by examiner

FIRE PROTECTION SPRINKLER TRIGGER ASSEMBLY

PRIORITY DATA

This application is a 35 U.S.C. § 371 application of International Application No. PCT/US2014/025052 filed Mar.12, 2014,which claims the benefit of priority to U.S. Provisional Patent Application No. 61/782,401,filed Mar. 14, 2013, each of which is incorporated by reference in its entirety.

TECHNICAL FIELD

The present invention relates generally to fire protection devices and, more specifically, to sprinkler assemblies and the arrangement and operation of their components.

BACKGROUND OF THE INVENTION

There are known automatic sprinklers that use an arrangement of lever members or pins in combination with a thermally responsive component and other internal components to support a seal assembly and form a fluid tight seal in the outlet of the sprinkler passageway in an unactuated state of the sprinkler. In U.S. Patent Publication No. 20100263883, an automatic sprinkler is shown in which a lever assembly is disposed against the sprinkler body to locate a bridge member for supporting a closure member in a sealed position. Other exemplary automatic sprinklers are shown in U.S. Pat. Nos. 6,367,559; 6,152,236; 5,664,630; 4,976,320 and 4,596,289.

DISCLOSURE OF INVENTION

Preferred embodiments of the sprinkler assembly provide for a fire protection sprinkler having a sprinkler frame, preferably formed from plastic, a seal assembly and a thermally sensitive trigger assembly to define the unactuated and actuated states of the sprinkler assembly. The trigger assembly includes a lever assembly and a thermally responsive element. The trigger assembly has a first configuration in the unactuated state of the sprinkler assembly to support and more preferably directly support the seal assembly and, in a second configuration of the lever assembly in an actuated state of the sprinkler assembly, to release the seal assembly. In preferred embodiments, the lever assembly forms a frictional engagement with the sprinkler frame, preferably a pivoted engagement and more preferably a snap fit engagement with the sprinkler frame.

One preferred embodiment of a sprinkler assembly includes a sprinkler frame having a proximal portion, a distal portion and an internal surface defining an internal fluid passageway having an inlet and an outlet extending axially through the proximal portion to the distal portion to define a central sprinkler axis of the frame. The distal portion of the sprinkler frame includes a plurality of surfaces to define a pair of chambers diametrically opposed about the passageway. The sprinkler assembly further preferably includes a seal assembly disposed in the outlet and a lever assembly. The lever assembly has a first configuration to support the seal assembly in the outlet and a second configuration to release the seal assembly from the outlet. The lever assembly preferably includes a pair of lever members in which each lever member has a first end and an opposite second end, wherein in the first configuration the first end is oriented such that a first portion of the first end forms a frictional engagement with the plurality of surfaces of one of the pair of chambers and a second portion of the first end engages the seal assembly. The frictional engagement is sufficient to support the seal assembly in an unactuated state of the sprinkler frame. In the second configuration, the first end is oriented such that the second portion of the first end is oriented out of engagement with the seal assembly.

Another preferred embodiment of the sprinkler assembly includes a sprinkler frame having a proximal portion, a distal portion and an internal surface defining an internal fluid passageway having an inlet and an outlet extending axially through the proximal portion to the distal portion to define a central sprinkler axis of the frame. The distal portion of the sprinkler frame includes a plurality of surfaces defining a pair of chambers diametrically opposed about the passageway. The preferred embodiment of the sprinkler assembly includes a seal assembly disposed in the outlet and a lever assembly having a first configuration to support the seal assembly in the outlet and a second configuration to release the seal assembly from the outlet. The preferred lever assembly includes a pair of lever members, in which each lever member has a first end and an opposite second end, the first end defining a receptacle for a pivoted engagement with the at least one of the plurality of surfaces defining the chamber. The at least one surface preferably includes a projection received in the receptacle.

BRIEF DESCRIPTION OF DRAWINGS

The accompanying drawings, which are incorporated herein and constitute part of this specification, illustrate exemplary embodiments of the invention and, together with the general description given above and the detailed description given below, serve to explain the features of the exemplary embodiments of the invention.

MODES(S) FOR CARRYING OUT THE INVENTION

Figure 1:
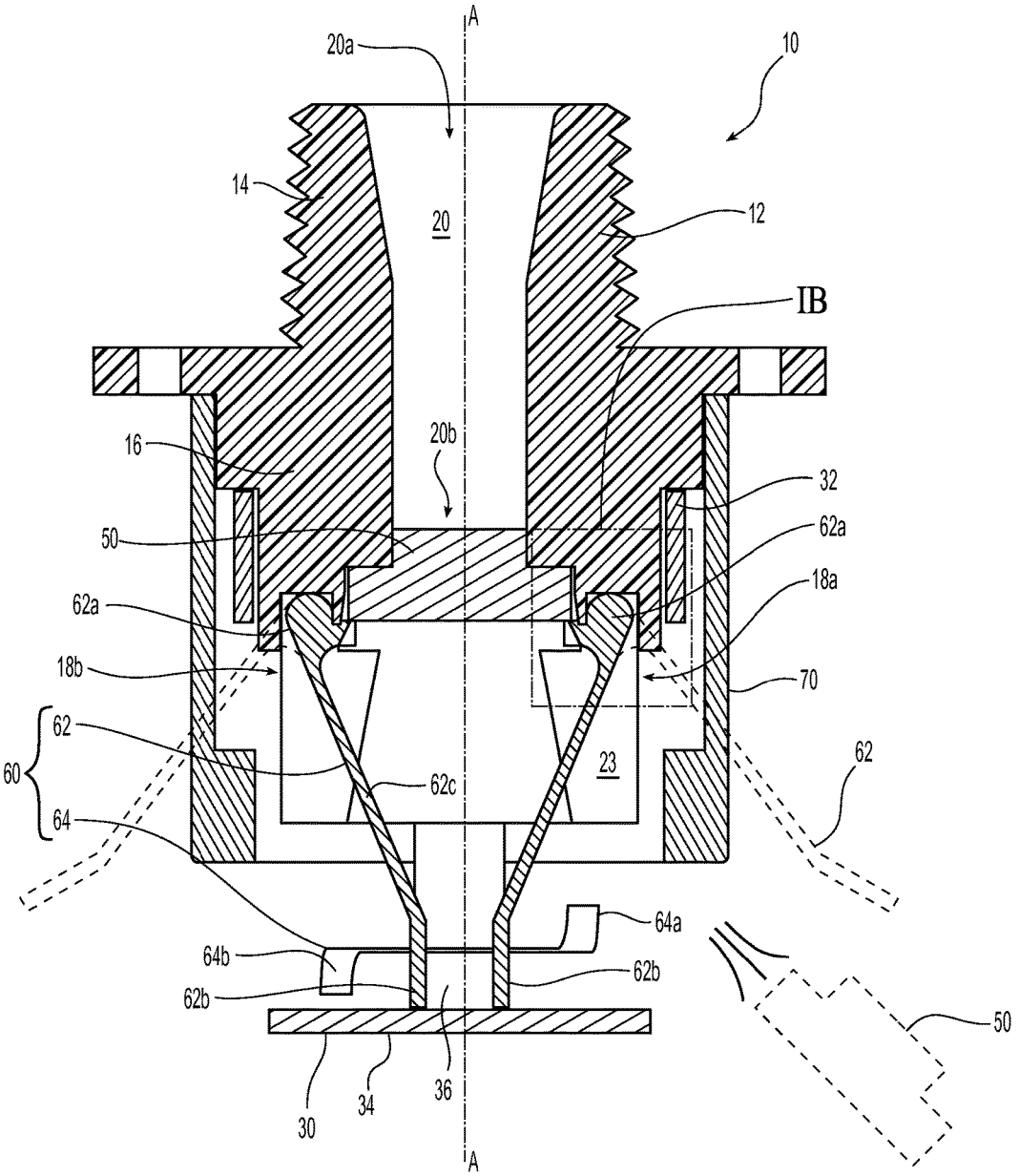
FIG. 1 is a cross-sectional view of a first embodiment of a preferred sprinkler assembly.
Figure 2A:
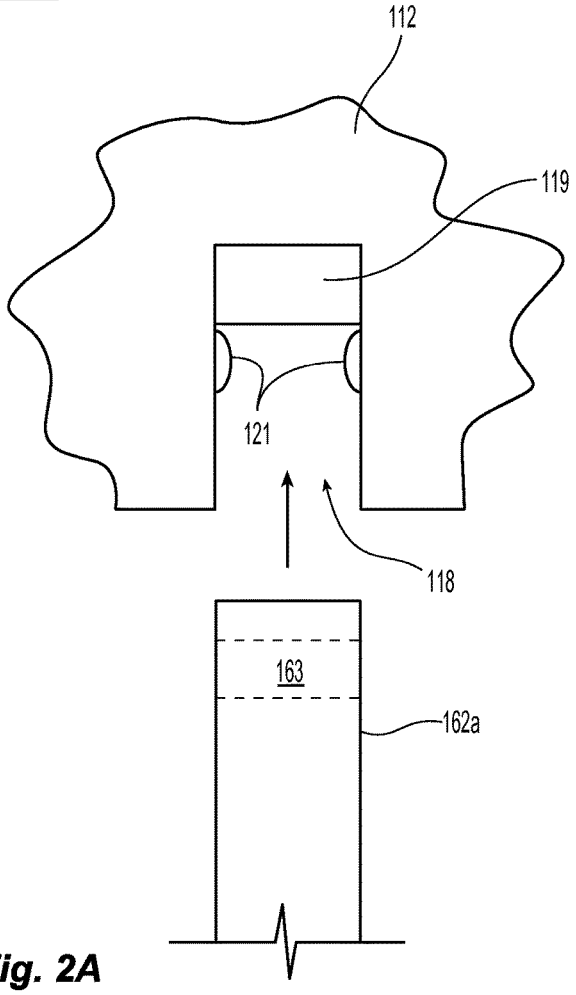
FIG. 2A is a detailed view of the sprinkler assembly of FIG. 2 along lines IIA-IIA.
Figure 2:
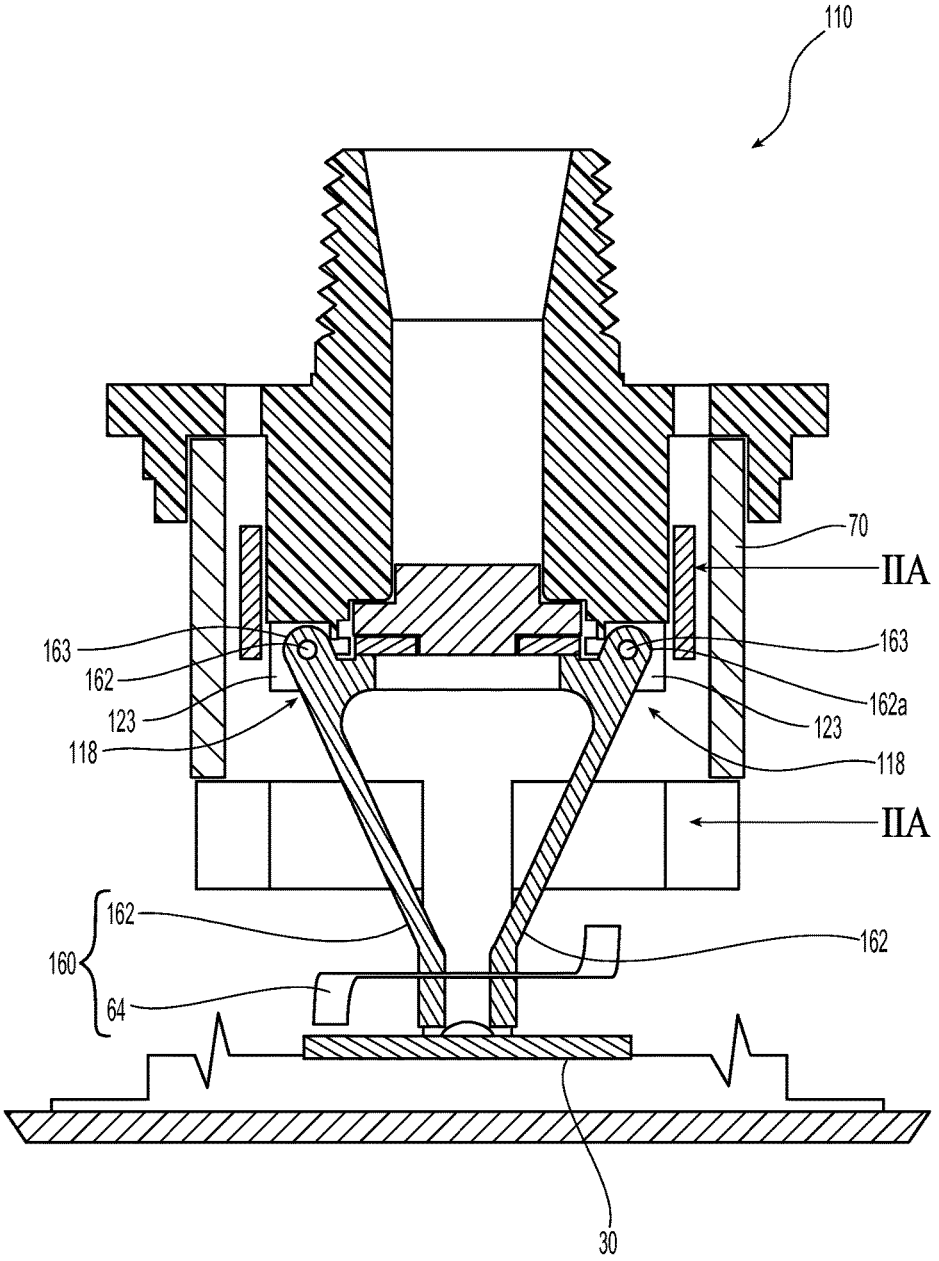
FIG. 2 is a cross-sectional view of another embodiment of a preferred sprinkler assembly.

Shown in FIGS. 1 and 2 are illustrative embodiments of an automatic fire protection sprinkler assembly in which a preferred lever-type trigger assembly supports a seal in the outlet of the sprinkler to maintain the sprinkler in an unactuated state and releases the seal upon thermal actuation of the sprinkler assembly. With reference to FIG. 1, the sprinkler assembly 10 generally includes a sprinkler body or frame 12 having a proximal portion 14 and distal portion 16. The sprinkler frame includes an outer surface and an internal surface. The internal surface of the sprinkler frame 12 defines an internal fluid passageway 20 having an inlet 20*a* into which a fire fighting fluid, such as for example water, is supplied and an outlet 20*b* from which the water is discharged for impacting a water distribution member, such as for example, the deflector assembly 30. The internal passageway 20 extends axially from the proximal portion 14 to the distal portion 16 to define a central longitudinal sprinkler axis A-A. The actuation of and discharge from the sprinkler assembly is controlled by the preferred thermally responsive lever-type trigger assemblies described herein.

Figure 1A:
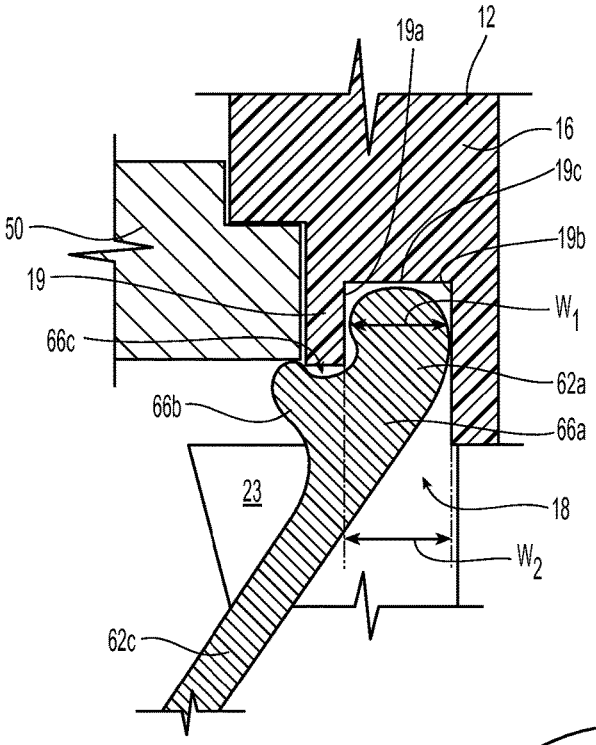
FIG. 1A is a detailed view of the sprinkler assembly of FIG. 1 in the area IB of FIG. 1.

As seen in FIGS. 1 and 1A, the preferred trigger assembly 60 in one configuration supports a seal assembly 50 in the sealed position against the outlet 20*b* of the sprinkler frame 12; and in another configuration (shown in dashed lines) releases the seal assembly 50 in the presence of a fire. The trigger assembly 60 preferably includes a lever assembly 62 and thermally responsive element 64. In an unactuated state of the sprinkler assembly 10, the thermally responsive element 64 maintains the trigger assembly 60 in a first configuration to support the seal assembly 50 in its sealed position engaged with the outlet 20*b*. In an actuated state of the sprinkler assembly 10 (shown in dashed lines), the thermally responsive element 64 releases the trigger assembly 60 to a second configuration to permit separation of the seal assembly 50 from the outlet 20*b* for the discharge of fluid.

In its first unactuated configuration and in order to support the seal assembly 50 in the sealed position, one end of the lever assembly 62 is preferably in pivoted engagement with a pair of diametrically opposed chambers 18*a*, 18*b* formed in the sprinkler frame 12 and more preferably formed at the distal end 16 of the sprinkler frame 12. The chambers 18*a*, 18*b* may partially circumscribe the sprinkler axis A-A. Alternatively or in addition to the two opposed chambers 18*a*, 18*b*, the sprinkler frame may define a single annular channel circumscribed about the sprinkler axis. The opposite end of the lever assembly 62 is preferably engaged with the thermally responsive element 64 to maintain the assembly 60 in its first configuration and engaged with the chambers 18. The lever assembly 62 preferably includes a pair of lever members 62. Each lever member 62 includes a first proximal end portion 62*a* for engaging the chambers 18*a*, 18*b* and a second distal end portion 62*b* for engaging the thermally responsive element 64 in the first configuration of the trigger assembly 60.

Referring to FIG. 1A, the first end 62*a* of the lever member 62 includes or defines an enlarged head 62*a* having a first portion 66*a* disposed in the chamber 18 and a second portion 66*b* projecting from the first portion 66*a* to support the seal assembly 50. The first portion 66*a* is preferably larger than the second portion 66*b*. Formed between the first and second portions 66*a*, 66*b* of the enlarged head 62*a* is a notch 66*c* for engaging the distal end 16 of the sprinkler frame 12 and more preferably the internal wall surface 19*a* of the chamber 18 to define a fulcrum about which the lever member 62 can pivot. In one embodiment, the chamber 18 is preferably defined by two parallel surfaces 19*a*, 19*b* defining a width of the chamber 18 therebetween, the chamber 18 being further preferably defined by a third surface 19*c* interconnecting the two parallel surfaces 19*a*, 19*b*. In the first configuration of the lever assembly 62, the first portion 66*a* of the head 62*a* is oriented such that its maximum width W1 extends substantially parallel to the width W2 of the chamber 18. Preferably, the maximum width W1 of the first portion 66*a* is dimensioned such that, in the first configuration of the lever member 62, the first portion 66*a* of the enlarged head 62*a* forms a preferred frictional or wedged engagement so as to provide a sufficiently resistant force to statically support the seal assembly 50 in the sealed position. In one particular embodiment, the levers form a snap-fit engagement with the surfaces defining the chamber 18. With the head 62*a* in its wedged engagement within the chamber 18, the second portion 66*b* is located against or engaged with the seal assembly 50 to support the seal assembly 50 against a sealing surface of the outlet 20*b* of the sprinkler frame 12.

The assembly sprinkler 10 is preferably pressure rated to maintain a static fluid pressure of about 500 pounds per square inch (psi). Thus, the first configuration of the trigger assembly 60 maintains the seal assembly 50 in the sealed position within the outlet 20*b* under a static fluid pressure load preferably of up to 500 pounds per square inch (psi). Therefore, provided the lever members 62 are oriented in their first configuration and prevented from pivoting within the chambers 18, the arrangement of the lever members 62 and thermally responsive element 64 provides a structure sufficient to maintain the sealed position of the closure assembly 50.

Referring again to FIG. 1, a fluid force applied in the inlet-to-outlet direction at the seal assembly 50 is distributed over the second portion 66*b* of the enlarged head 62*a* of the lever member 62 to bias and pivot the lever member 62 radially away from the sprinkler axis A-A. In order for the lever member 62 to support the sealing assembly 50 in its sealing position, the lever member 62 must be a static member. Accordingly, in response to the outward biasing force, the thermally responsive element 64 applied to the distal end 62*b* of the lever member 62 provides a resistive force to maintain the lever member 62 in its static position of the first configuration. More specifically, the thermally responsive element 64 acts on the lever member 62 such the moments about the pivot point at notch 66*c* sum to zero.

Referring to FIG. 1, the thermally responsive element 64 is preferably configured as a thermally responsive link that includes a first plate member 64*a* and a second plate member 64*b* coupled to one another by a thermally sensitive solder material. The plate members are engaged and soldered to one another about the distal ends 62*b* of the lever members 62 to orient the first or proximal ends 62*a* of the lever members 62 in their first configuration within the chambers 18*a*, 18*b*. The first and second plate members 64*a*, 64*b* are preferably coupled together by a fusible thermally sensitive material such as, for example, a eutectic solder material rated to melt in the presence of sufficient heat generated by, for example, a fire event. Accordingly, the thermally responsive element 64 is preferably a thermally rated link device that defines the thermal rating of the sprinkler. Preferably, the thermally responsive element 64 is configured to define a thermal rating for the sprinkler assembly 10 ranging between 140° F. and 212° F.; more preferably, the sprinkler assembly 10 is thermally rated for 165° F. In addition, the thermally responsive element 64 can be configured as a standard response or a fast response link device. Preferably, the solder material and the link device define the preferred response time index (RTI) of less than 50 $(m\text{-}s)^{1/2}$.

Given the function of the first configuration of the lever assembly 62 to support the seal assembly 50 in the unactuated state, the thermally responsive element 64 and lever assembly 62 work together to load or seal the automatic sprinkler assembly 10 for its installation and use. To load the sprinkler, the lever assembly 62 and its heads 62*a* are preferably snap-fitted into the chambers 18 and rotated about its preferred notch 66*c* against, for example, a wall or ridge 19*a* of the distal end 16 of the frame 12 forming the chamber 18 and into supporting engagement with the seal assembly 50. With the levers properly oriented in the first configuration, the thermally responsive element 64 is preferably engaged and soldered about the distal end 62*b* of the lever members 62. The thermally responsive element 64 may be of a known configuration provided it is sufficiently responsive for the particular application and can support the lever assembly in its first configuration. Thus, the intermediate lever segment 62*c* shown connecting the lever ends 62*a*, 62*b* is of a preferred linear configuration. However other configurations are possible, for example curvilinear, provided the intermediate segment 62*c* can locate the first and second ends of the lever members 62 for coupling by the thermally responsive element 64, loading in the first configuration and permit operation of the sprinkler assembly in the second configuration of the lever assembly as described herein.

Upon exposure to a sufficient level of heat, the thermally sensitive material between the plate members 64*a*, 64*b* melts, thereby allowing the plate members to separate. Without the restraint of the thermal element 64, the lever members 62 are permitted to pivot (shown in dashed lines), to define the second configuration in which the lever assembly does not support the seal assembly 50. More particularly, the head end 62*a* is oriented such that the second portion 66*b* is out of contact or disengaged from the seal assembly 50 such that the seal assembly is released from its sealed position within the outlet 20*b*. The fluid discharge from the outlet 20*b* is able to eject the seal assembly 50 (shown in broken lines in FIG. 1) and actuate the sprinkler 10.

The embodiment of FIGS. 1 and 1A utilize a preferred frictional engagement between the lever 62 and the walls 19*a*, 19*b* of the chamber 18 to provide the reactive or static forces for maintaining the seal assembly 50 in the sealed position. In an alternate embodiment of the sprinkler 110, shown in FIGS. 2 and 2A, the preferred lever assembly may include individual lever members 162 in which the first or proximal head 162*a* of the lever member is configured for a pin-type connection within the chamber 118 of the sprinkler frame 112. Accordingly, the head 162*a* of each lever member 162 includes a through hole or receptacle 163 for receiving a detent, pin or other projection preferably formed in the chamber 118 at the distal end 116 of the sprinkler frame 112.

Shown in the detailed view of FIG. 2A is a partial exploded view of the head 162*a* and chamber 118. The head includes an axially extending through hole 163. Alternatively, the head 162*a* can be configured with axially aligned receptacles that do not extend through the head 162*a* but are deep enough to receive a pin or other projection disposed within the chamber 118. For example, the sprinkler frame 112 can be formed so as to include a pair of axially aligned detents 121 or other projection within the chamber 118 which engage the receptacle 163 to provide for the pivot connection between the levers 162 and the sprinkler frame 112. Thus, the lever members 162 can be snapped into the chambers 118 so as to be retained by the engagement between the receptacles 163 of the heads 162*a* and the detents 121. Loading of the sprinkler assembly 110 and operation of the preferred trigger assembly 160 otherwise proceeds similarly to that of the previously described embodiment of the sprinkler assembly 10.

In each of the above described embodiments, the lever assembly 62, 162 is engaged with the chamber 18, 118 formed in the distal portion of the sprinkler frame 12, 112. Preferably, the sprinkler frame in each embodiment is formed from plastic, such as for example, Chlorinated Polyvinyl Chloride (CPVC) material, more specifically CPVC material per ASTM F442 and substantially similar to the material used to manufacture the BLAZEMASTER® CPVC sprinkler pipe and fittings as shown and described in the technical data sheet, TFP1915: "Blazemaster CPVC Sprinkler Pipe and Fittings Submittal Sheet" (June 2008). Alternatively, the sprinkler frame may be formed by alternate material, for example, cast from bronze. The sprinkler frame may include features, in addition to the chamber 18, 118, to facilitate installation and/or operation of the preferred lever assembly 62, 162. For example, the sprinkler frame 12, 112 may include a channel 23, 123 formed at the distal end 16 of the frame 12 bisecting the distal end 16 of the sprinkler frame 12 and in communication with the diametrically opposed chambers 18. Accordingly, the distal end 16 of the frame 12 can terminate distal of the outlet 20*b* without interfering with the pivot operation of the levers 62. Alternatively, the terminal end 16 of the sprinkler frame 12 can terminate just proximal of, distal of, or closely adjacent to the outlet 20*b* of the passageway 20.

With reference to FIG. 1, the sprinkler assembly 10 may be configured as either a pendent, a concealed pendent or a sidewall sprinkler in which the assembly 10 preferably includes operational components of a fire protection sprinkler, such as for example, i) a closure or seal assembly 50 and ii) a thermally responsive trigger assembly 60 which maintain the sprinkler assembly 10 in an unactuated state when coupled to a fire fighting fluid pipe supply. In the preferred configuration and operation of the sprinkler assembly 10, the deflector assembly 30 axially translates with respect to the sprinkler frame 12 distally from a first unactuated position to a second actuated position. Axial translation of the deflector assembly 30 can be limited by a support cup 70 surrounding the sprinkler frame 12 or may alternatively be limited by a projection, ridge or other structure formed on the sprinkler frame 12 (not shown).

A preferred deflector assembly 30 preferably includes a proximal portion and a distal portion with an extension therebetween to couple and space the distal portion from the proximal portion. As shown, the proximal portion of the deflector assembly 30 defines a receiver portion 32 which preferably surrounds and more preferably circumferentially surrounds the sprinkler frame 12. The distal portion of the sprinkler assembly 30 includes a deflector member 34 configured for distribution of water discharged from the outlet 20*b* to address a fire. Extending between the receiver 32 and the deflector member 34 are one or more extension members 36. The extension member(s) 36 space the deflector member 34 from the receiver 32 and more particularly axially locate the deflector member from the outlet 20*b*. The deflector assembly 30 can be configured for relative translation with respect to the sprinkler frame 12. Alternatively, the deflector assembly 30 and its deflector member 34 can be fixed with respect to the outlet 20*b*.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A sprinkler assembly comprising:

a sprinkler frame having a proximal portion, a distal portion and an internal surface defining an internal fluid passageway having an inlet and an outlet extending axially through the proximal portion to the distal portion to define a central sprinkler axis of the frame, the distal portion of the sprinkler frame including a plurality of surfaces to define a pair of chambers diametrically opposed about the passageway;

a seal assembly disposed in the outlet; and a lever assembly having a first configuration to support the seal assembly in the outlet and a second configuration to release the seal assembly from the outlet; the lever assembly including a pair of lever members, each lever member having a first end and an opposite second end, the first end of each lever defining an enlarged head wherein in the first configuration the first end is oriented such that a first portion of the first end forms a frictional engagement with the plurality of surfaces of one of the pair of chambers and a second portion of the first end engages the seal assembly, the frictional engagement being sufficient to support the seal assembly in an unactuated state of the sprinkler assembly, and wherein in the second configuration the first end is oriented such that the second portion of the first end is oriented out of en engagement with the seal assembly; and wherein the plurality of surfaces defining each of the chambers includes a pair of parallel surfaces, each of which are parallel to the central sprinkler axis, defining a width of each chamber, the first portion of the first end of the lever member defining a maximum width of the first end of the lever member, wherein the first configuration of the lever assembly orients the maximum width of the first portion of the first end of the lever member substantially parallel to the width of the each chamber to form the frictional engagement.

2. The sprinkler assembly of claim 1, further comprising a thermally responsive element holding the second end of the pair of lever members together to maintain the lever assembly in the first configuration.

3. The sprinkler assembly of claim 2, wherein the thermally responsive element includes a first plate member and a second plate member coupled together by a eutectic solder material.

4. The sprinkler assembly of claim 1, wherein the first and second portions of the first end of each lever member defines a notch therebetween, the notch engaging one of the plurality of surfaces of the chamber to define a fulcrum about which the lever member pivots.

5. The sprinkler assembly of claim 1, wherein the first end of each lever member defines an enlarged head of the lever member, the first portion of the lever member being larger than the second portion, a notch being formed between the first and second portions.

6. The sprinkler assembly of claim 1, wherein in the first configuration the lever assembly supports the seal assembly under a maximum static fluid pressure of 500 psi.

7. The sprinkler assembly of claim 1, wherein the pair of chambers partially circumscribes the sprinkler axis.

8. The sprinkler assembly of claim 1, wherein the pair of chambers are continuous and define a single annular channel circumscribed about the sprinkler axis.

9. The sprinkler assembly of claim 1, wherein the distal portion of the sprinkler frame defines a channel bisecting the distal end of the sprinkler frame and in communication with the pair of chambers.

10. The sprinkler assembly of claim 1, wherein the sprinkler frame is formed from a plastic material.

11. The sprinkler assembly of claim 10, wherein the plastic material is CPVC.

12. The sprinkler assembly of claim 10, wherein the first end of each lever member forms a snap-fit engagement with the plurality of walls defining the chamber.

13. The sprinkler assembly of claim 1, further comprising a deflector assembly having a proximal receiver portion and a distal deflector member, the deflector assembly configured for translation with respect to the sprinkler frame upon system actuation.

14. The sprinkler assembly of claim 1, further comprising a deflector assembly having a proximal receiver portion and a distal deflector member, the deflector assembly configured to be fixed with respect to the sprinkler frame upon system actuation.

15. A sprinkler assembly comprising:

a sprinkler frame having a proximal portion, a distal portion and an internal surface defining an internal fluid passageway having an inlet and an outlet extending axially to define a central sprinkler axis of the frame, the distal portion of the sprinkler frame including a pair of parallel walls, each of which are parallel to the central sprinkler axis, defining a pair of chambers disposed about the passageway;

a seal assembly disposed in the outlet;

a thermally responsive element; and a lever assembly for supporting the seal assembly in the outlet, the lever assembly including a pair of lever members, each lever member having a first end and an opposite second end with a linear portion connecting the first end and the second end, the first end defining an enlarged head, the first end having a first portion and a second portion defining a notch between the first and second portion, the first portion of the first end disposed in each of the chambers so as to form a frictional engagement with the parallel walls of that chamber, the second portion of the first end engaged with the seal assembly so that the notch forms a pivoted engagement with the distal portion of the sprinkler frame, the second ends of the lever members being engaged with the thermally responsive element to maintain the first portion of the first end within the each of the chambers and the second portion of the first end in engagement with the seal assembly to support the seal assembly within the outlet in an unactuated state of the sprinkler assembly.

* * * * *